US008377290B2

(12) United States Patent
Tock et al.

(10) Patent No.: US 8,377,290 B2
(45) Date of Patent: Feb. 19, 2013

(54) LOW SULFUR FUELS

(75) Inventors: Richard William Tock, Humbolt, IA (US); James Kenneth Sanders, Lubbock, TX (US); Duck Joo Yang, Flower Mound, TX (US)

(73) Assignee: James K. and Mary A. Sanders Family L.L.C., Lubbock, TX (US)

( * ) Notice: Subject to any disclaimer, the term of this patent is extended or adjusted under 35 U.S.C. 154(b) by 754 days.

(21) Appl. No.: 12/415,018

(22) Filed: Mar. 31, 2009

(65) Prior Publication Data

US 2010/0243531 A1 Sep. 30, 2010

(51) Int. Cl.
*C10G 29/06* (2006.01)

(52) U.S. Cl. ..... 208/244; 208/246; 208/247

(58) Field of Classification Search ..... 208/244, 208/246, 247

See application file for complete search history.

(56) References Cited

U.S. PATENT DOCUMENTS

| | | | | |
|---|---|---|---|---|
| 3,666,660 | A * | 5/1972 | Bernheimer | 208/243 |
| 3,996,130 | A * | 12/1976 | Nametkin et al. | 208/243 |
| 4,545,879 | A * | 10/1985 | Wan et al. | 204/157.6 |
| 5,266,082 | A | 11/1993 | Sanders | |
| 5,433,756 | A | 7/1995 | Gonzalez | |
| 5,525,316 | A | 6/1996 | Shustorovich et al. | |
| 5,823,758 | A | 10/1998 | Lack | |
| 5,951,722 | A | 9/1999 | Sanders et al. | |
| 6,110,237 | A | 8/2000 | Spencer et al. | |
| 6,113,660 | A | 9/2000 | Hubbard et al. | |
| 6,152,972 | A | 11/2000 | Shustorovich et al. | |
| 6,312,480 | B1 | 11/2001 | Jakob et al. | |
| 6,402,939 | B1 * | 6/2002 | Yen et al. | 208/196 |
| 6,866,010 | B2 | 3/2005 | May | |
| 7,229,482 | B2 | 6/2007 | May | |
| 7,268,097 | B2 * | 9/2007 | Katsuno et al. | 502/259 |
| 2006/0254130 | A1 | 11/2006 | Scattergood | |
| 2007/0227951 | A1 * | 10/2007 | Thirugnanasampanthar et al. | 208/243 |

OTHER PUBLICATIONS

MSDS, diesel fuel, rev. 2006.*

International Search Report for International Application No. PCT/US08/66016 dated Aug. 19, 2008.

Written Opinion of the International Searching Authority for International Application No. PCT/US08/66016 dated Aug. 19, 2008.

* cited by examiner

*Primary Examiner* — Walter D Griffin
*Assistant Examiner* — Renee E Robinson
(74) *Attorney, Agent, or Firm* — Turocy & Watson, LLP

(57) ABSTRACT

Provided are methods of reducing a sulfur concentration in a liquid fuel and methods of forming a thiophene/metal complex in a liquid fuel. The method can involve combining a liquid fuel and at least one metal acetate to form a thiophene/metal complex and substantially removing the thiophene/metal complexes from the liquid fuel. A thiophene concentration in a liquid fuel is reduced by the formation of an insoluble complex salt, which can be removed by, for example, centrifuge, filtration, decantation, and/or distillation.

20 Claims, 3 Drawing Sheets

LOW SULFUR FUELS

TECHNICAL FIELD

Provided are methods of reducing the sulfur concentration in a liquid fuel.

BACKGROUND

A substantial portion of hydrocarbon fractions used to prepare fuels such as motor gasoline are derived from catalytic cracking of heavy petroleum fractions such as vacuum gas oils. The cracked materials are typically distilled into fractions including naphtha, heating oil, and diesel fuel.

Cracked naphthas are obtained from catalytic crackers in relatively high volumes and generally have good octane numbers. They are major components in blending for the motor gasoline pool. A substantial portion of the octane rating of cracked naphtha is due to its high olefin content.

Among the primary contaminants in feeds to fluidized catalytic cracking units are sulfur bearing materials. These sulfur contaminants result in the appearance of sulfur species in the cracked products. Heavy gasoline components are known to accumulate sulfur impurities.

Combustion of gasoline and diesel fuels during use in internal combustion engines converts the sulfur contaminants into sulfur oxides. The sulfur oxides are environmentally undesirable and also have been found to have a long-term deactivation impact on automotive catalytic converters that are used to remove nitrogen oxide and unburned hydrocarbon contaminants from automotive emissions. In order to improve air quality, environmental protection agencies of various industrialized countries have therefore announced or proposed new regulations requiring reduction in sulfur content of gasoline, diesel, and other motor fuels.

SUMMARY

The following presents a simplified summary of the innovation in order to provide a basic understanding of some aspects of the innovation. This summary is not an extensive overview of the innovation. It is intended to neither identify key or critical elements of the innovation nor delineate the scope of the innovation. Rather, the sole purpose of this summary is to present some concepts of the innovation in a simplified form as a prelude to the more detailed description that is presented hereinafter.

The subject innovation provides methods of reducing a sulfur concentration in a liquid fuel and methods of forming a thiophene/metal complex in a liquid fuel. In one aspect of the subject innovation, the method involves combining a liquid fuel and at least one metal acetate to form a thiophene/metal complex and substantially removing the thiophene/metal complexes from the liquid fuel. In another aspect of the subject innovation, the method involves combining a liquid fuel and at least one metal acetate to form a thiophene/metal complex; contacting the combined liquid fuel and the metal acetate with ultrasound vibrations to facilitate forming the thiophene/metal complex; and substantially removing the liquid fuel from the thiophene/metal complexes. In yet another aspect of the subject innovation, the method involves combining a liquid fuel and at least one metal acetate and contacting the combined liquid fuel and the metal acetate with ultrasound vibrations. A thiophene concentration in a liquid fuel is reduced by the formation of an insoluble complex salt, which can be removed by, for example, centrifuge, filtration, and/or distillation.

To the accomplishment of the foregoing and related ends, the innovation comprises the features hereinafter fully described and particularly pointed out in the claims. The following description and the annexed drawings set forth in detail certain illustrative aspects and implementations of the innovation. These are indicative, however, of but a few of the various ways in which the principles of the innovation may be employed. Other objects, advantages and novel features of the innovation will become apparent from the following detailed description of the innovation when considered in conjunction with the drawings.

DETAILED DESCRIPTION

Figure 1:
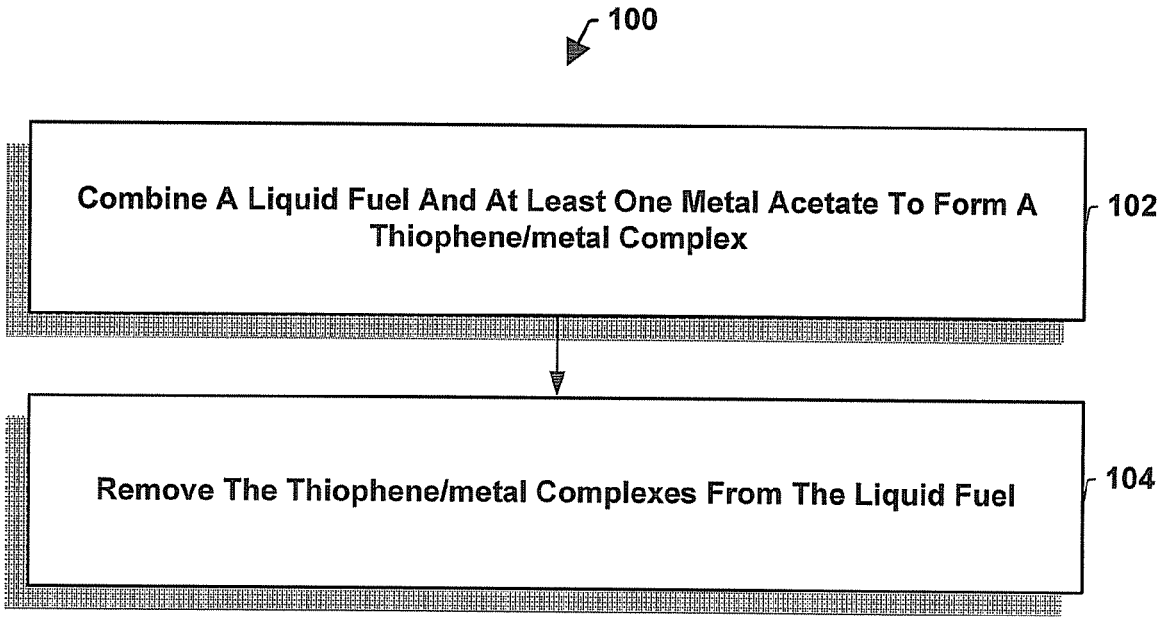
FIG. 1 is a flowchart illustrating an exemplary method of reducing a sulfur concentration in a liquid fuel in accordance with one aspect of the specification.

The promulgation of recent and expected environmental legislation has forced gasoline, diesel, aviation, and jet fuel suppliers to reduce the sulfur content of their fuels. Petroleum refineries typically employ several different technologies to produce new, low sulfur fuels. The most widely practice technology is hydro-treating where the sulfur in a feedstock is chemically converted to gaseous hydrogen sulfide at high temperature and pressure. The gaseous hydrogen sulfide is then separated from the liquid hydrocarbon fuel. Hydro-treating, however, is an expensive process. In the production of higher octane gasoline, an additional cost is incurred since hydro-treating causes a decrease in the octane level of the base feedstock and results in a lower valued product.

A newer technology attempts to chemically covert the organic sulfur to gaseous oxides. This approach also generates oxygenated organic compounds in the fuel and lowers the energy density of the fuel. Physical separations based on membrane and selective absorbent technologies have their own drawbacks with the required addition of equipment and limited removal efficiencies.

The subject innovation described herein employs chemical formation of complex salts of thiophenes in a liquid fuel. Thiophenes represent the most difficult organic sulfur compounds to be removed from fuels. The thiophene/metal complex salts, however, are insoluble in the bulk fuel and can be removed by, for example, centrifuging, filtration, decantation, distillation (e.g., reactive distillation), or the like. The formation of the thiophene/metal complex can be facilitated by sonochemistry. This innovation can be amenable to reactive distillation technology and thereby provide direct implementation into the refinery processes with little additional cost.

The claimed subject matter is described with reference to the drawings, wherein like reference numerals may be used to refer to like elements throughout. In the following description, for purposes of explanation, numerous specific details are set forth in order to provide a thorough understanding of the subject innovation. It may be evident, however, that the claimed subject matter may be practiced without these specific details. In other instances, well-known structures and devices may be shown in block diagram form in order to facilitate describing the subject innovation.

FIG. 1 illustrates an exemplary method 100 of reducing a sulfur concentration in a liquid fuel. At 102, the liquid fuel and at least one metal acetate are combined to form a thiophene/metal complex. Examples of liquid fuels include hydrocarbon fuels such as gasoline, reformulated gasoline, diesel, jet fuel, marine fuel, kerosene, biofuels such as biodiesel, bioalcohols such as bioethanol, and the like. Gasoline can contain one or more of the following components that may, by itself, constitute liquid fuel: straight-run products, reformate, cracked gasoline, high octant stock, isomerate, polymerization stock, alkylate stock, hydrotreated feedstocks, desulfurization feedstocks, alcohol, and the like.

Any suitable metal acetate can be employed in the subject innovation as long as the metal acetate can form a thiophene/metal complex in the liquid fuel. Examples of metal acetates include acetates of metal elements selected from the group consisting of Group VIII metals, Group IB metals, and Group IIB metals of the Periodic Table of Elements. Specific examples of metal acetates include ferric acetate, cobalt acetate, nickel acetate, palladium acetate, platinum acetate, copper acetate, silver acetate, gold acetate, zinc acetate, cadmium acetate, and mercuric acetate. The liquid fuel can be combined with one metal acetate or combinations of two or more metal acetates.

The concentration of metal acetate in the mixture of the liquid fuel and the metal acetate can be any suitable concentration so that the metal acetate concentration can facilitate the formation of the thiophene/metal complex in the mixture. In one embodiment, the concentration of metal acetate in the mixture is about 0.1 wt. % or more and about 5 wt. % or less. In another embodiment, the concentration of metal acetate in the mixture is about 0.1 wt. % or more and about 0.5 wt. % or less. In yet another embodiment, the concentration of metal acetate in the mixture is about 1 wt. % or more and about 2.5 wt. % or less. In still yet another embodiment, the concentration of metal acetate in the mixture is about 3 wt. % or more and about 5 wt. % or less.

When two or more metal acetates are used, any suitable ratio of one metal acetate to another can be used. For example, zinc acetate and nickel acetate are used to form the thiophene/metal complex, a ratio of zinc acetate to nickel acetate is from about 1:50 to about 50:1. In another embodiment, a ratio of zinc acetate to nickel acetate is from about 1:20 to about 20:1. In yet another embodiment, a ratio of zinc acetate to nickel acetate is from about 1:10 to about 10:1. In still yet another embodiment, a ratio of zinc acetate to nickel acetate is from about 1:5 to about 5:1.

The metal acetate can be combined with a liquid fuel by any suitable technique. In one embodiment, the metal acetate is combined with a liquid fuel by directly dissolving the metal acetate in the liquid fuel. In another embodiment, the metal acetate is dissolved in an organic solvent, and the metal acetate solution is then mixed with a liquid fuel.

When the metal acetate is added as a mixture with an organic solvent (e.g., metal acetate solution), the concentration of the metal acetate in the metal acetate solution is about 0.1 wt. % or more and about 5 wt. % or less. In another embodiment, the concentration of the metal acetate in the metal acetate solution is about 0.1 wt. % or more and about 0.5 wt. % or less. In yet another embodiment, the concentration of the metal acetate in the metal acetate solution is about 1 wt. % or more and about 2.5 wt. % or less. In still yet another embodiment, the concentration of the metal acetate in the metal acetate solution is about 3 wt. % or more and about 5 wt. % or less.

The organic solvent can be any suitable solvent as long as it is capable of dissolving the metal acetate. Examples of organic solvents include alcohols having 1 to about 18 carbon atoms which may have an alkyl group such as methanol, ethanol, propanol, pentanol, hexanol, octanol, 2-ethylhexanol, dodecanol, octadecyl alcohol, benzyl alcohol, phenylethyl alcohol, cumyl alcohol and isoplropylbenzyl alcohol; alkanes such as butane, pentane, hexane, heptane, octanes, cyclopentane, and cyclohexane; oxygen containing compounds such as glycols; ketones; esters; ethers; and the like.

During or after combining the metal acetate and the liquid fuel, the thiophene/metal complex can be formed in the mixture of the metal acetate and the liquid fuel. Agitation can be used to ensure a thorough dispersion of the metal acetate in the mixture. Agitation method may range from simply stirring to sonicating (e.g., using ultrasound) or combinations thereof. The thiophene/metal complex can be formed under any suitable conditions. The formation of the thiophene/metal complex can also be carried out in two or more stages under different conditions.

The thiophene/metal complex can be formed in the mixture of the metal acetate and the liquid fuel at any suitable temperature. In one embodiment, the thiophene/metal complex is formed at about −30 degrees Celsius or more and about 100 degrees Celsius or less. In another embodiment, the thiophene/metal complex is formed at about 0 degree Celsius or more and about 80 degrees Celsius or less. In yet another embodiment, the thiophene/metal complex is formed at about 10 degrees Celsius or more and about 70 degrees Celsius or less. In still yet another embodiment, the thiophene/metal complex is formed at about an ambient temperature.

The thiophene/metal complex can be formed in the mixture of the metal acetate and the liquid fuel for any suitable period of time. In one embodiment, the thiophene/metal complex is formed for about 15 minutes or more and about 10 hours or less. In another embodiment, the thiophene/metal complex is formed for about 20 minutes or more and about 5 hours or less. In yet another embodiment, the thiophene/metal complex is formed for about 25 minutes or more and about 3 hours or less.

At 104 in FIG. 1, the thiophene/metal complex is substantially removed from the liquid fuel. The thiophene/metal complex can be substantially removed from the liquid fuel by any suitable technique. Since the thiophene/metal complex is insoluble in the liquid fuel, the thiophene/metal complex can be substantially removed from the liquid fuel by centrifugation, decantation, filtration, combinations thereof, or the like. The removal of the thiophene/metal complex can be carried out batchwise or continuously.

In one embodiment, the thiophene/metal complex is substantially removed from the mixture by centrifugation at about 100 rpm or more and about 3,000 rpm or less for about 1 minute or more and about 30 minutes or less. In another embodiment, the thiophene/metal complex is substantially removed by centrifugation followed by decantation. In yet another embodiment, the thiophene/metal complex is substantially removed from the mixture by using a filter such as a paper filter, fabric filter, nonwoven fabric filter, diatom filter, metallic mesh, sintered metal, porous material, combinations thereof, and the like.

A series of acts of combining metal acetate and a liquid fuel and substantially removing a thiophene/metal complex can be conducted at any suitable number of times, for example, to achieve sufficient removal of sulfur from the liquid fuel. In one embodiment, the series of acts is conducted at about one time. In another embodiment, the series of acts is repeated at about two times or more and about five times or less.

Figure 2:
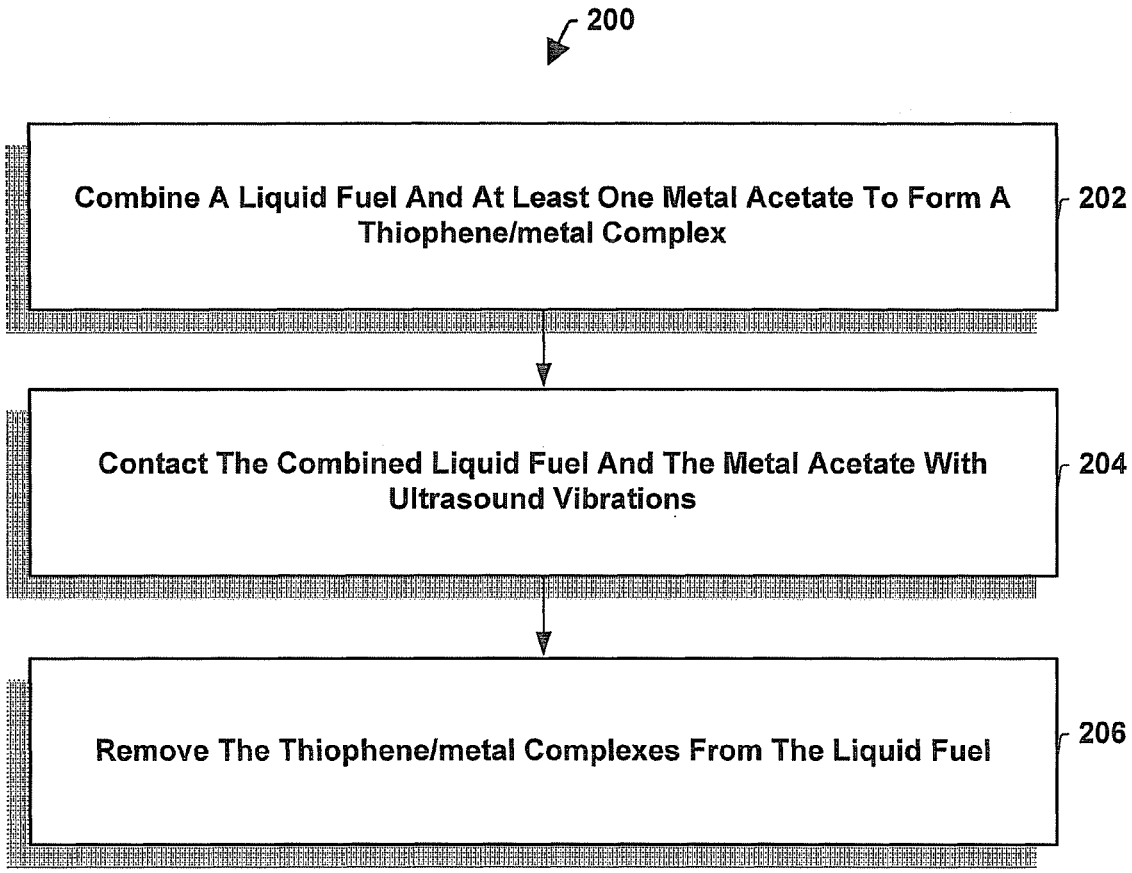
FIG. 2 is a flowchart illustrating another exemplary method of reducing a sulfur concentration in a liquid fuel in accordance with one aspect of the specification.

FIG. 2 illustrates another exemplary method 200 of reducing a sulfur concentration in a liquid fuel. At 202, a liquid fuel and at least one metal acetate are combined to form a thiophene/metal complex. The metal acetate can be combined with the liquid fuel by any suitable technique. For example, the metal acetate is combined with the liquid fuel in the same manner as described in connection with FIG. 1.

At 204, the combined liquid fuel and metal acetate are contacted with ultrasound vibrations. The formation of the thiophene/metal complex can be facilitated by sonochemistry. Sonochemistry is the science of using the acoustic energy in ultrasound to bring about physical and chemical changes. Ultrasound is broadly defined as sound having a frequency above about 18-20 kHz (the upper limit of human hearing) to about 100 MHz. Ultrasound having a frequency less than above 5 MHz can be useful for sonochemistry since it can produce cavitation in liquids, the source of chemical effects.

The sonochemical treatment can be conducted by any suitable technique. In one embodiment, the mixture is treated by ultrasound with a probe (e.g., an ultrasound horn or ultrasonic horn) that transmits ultrasound vibrations. The ultrasound horn can be immersed in the mixture where the ultrasound vibrations are transmitted directly to the mixture. In one embodiment, the sonochemical treatment forms a slurry of the mixture. The sonochemical treatment can be performed in any suitable manner. For example, ultrasound vibrations are transmitted to the mixture in a batch reactor, continuous flow reactor, semi-continuous flow reactor, or the like.

The ultrasound irradiation is applied under any suitable condition to facilitate the formation of thiophene/metal complex in the mixture. The conditions depend upon, for example, the constituents of the metal acetate and/or liquid fuel, the concentration of the metal acetate in the mixture, the desired removal rate of sulfur, or the like. Examples of conditions include an intensity, a frequency, a period of time, or the like.

Any suitable intensity of ultrasound irradiation can be employed to facilitate the formation of thiophene/metal complex in the mixture. In one embodiment, intensity of ultrasound irradiation is from about 0.005 $W/cm^2$ or more and about 50 $W/cm^2$ or less. In another embodiment, intensity of ultrasound irradiation is from about 0.01 $W/cm^2$ or more and about 10 $W/cm^2$ or less. In yet another embodiment, intensity of ultrasound irradiation is from about 0.1 $W/cm^2$ or more and about 5 $W/cm^2$ or less.

Any suitable frequency of the ultrasound can be employed to facilitate the formation of thiophene/metal complex in the mixture. In one embodiment, a frequency is about 20 kHz or more and about 10 MHz or less. In another embodiment, a frequency is about 20 kHz or more and about 1 MHz or less. In yet another embodiment, a frequency is about 20 kHz or more and about 100 kHz or less The ultrasound irradiation can be contacted with the mixture for a sufficient time to facilitate forming the thiophene/metal complex in the mixture. The thiophene/metal complex can be formed in the mixture by sonochemistry for a short period of time. In one embodiment, the thiophene/metal complex is formed by sonochemistry for about 5 minutes or more and about 1 hour or less. In another embodiment, the thiophene/metal complex is formed by sonochemistry for about 7 minutes or more and about 50 minutes or less. In yet another embodiment, the thiophene/metal complex is formed by sonochemistry for about 10 minutes or more and about 40 minutes or less. In still yet another embodiment, the sonochemistry treatment is carried out until slurry of the mixture is formed. That is, the sonochemistry treatment is terminated when slurry of the mixture is formed.

At 206 in FIG. 2, the thiophene/metal complex is substantially removed from the mixture. The thiophene/metal complex can be substantially removed from the fuel mixture by any suitable technique. For example, the thiophene/metal complex can be substantially removed from the mixture in the same manner as described in connection with FIG. 1.

A series of acts of combining metal acetate and a liquid fuel; contacting the combined liquid fuel and the metal acetate with ultrasound vibrations; and substantially removing a thiophene/metal complex can be conducted at any suitable number of times, for example, to achieve sufficient removal of sulfur from the liquid fuel. In one embodiment, the series of acts is conducted at about one time. In another embodiment, the series of acts is repeated at about two times or more and about five times or less.

In one embodiment, the compounds used in the subject innovation are substantially free of sulfur and/or free of sulfur containing moieties to avoid residual sulfate contamination. For example, the metal acetates are substantially free of sulfur. The organic solvent is substantially free of sulfur.

The following examples illustrate the subject innovation. Unless otherwise indicated in the following examples and elsewhere in the specification and claims, all parts and percentages are by weight, all temperatures are in degrees Celsius, and pressure is at or near atmospheric pressure.

Example 1

Nickel acetate salt (7.0 g) and zinc acetate salt (6.0 g) are first dissolved in absolute ethanol (100 milliliters (ml)). The ethanol/acetate salt solution (100 ml) is then added to a fuel (100 ml) to yield a total of 200 ml of mixture in a 400 ml beaker. The fuel is obtained from Pro Petroleum's refinery at 408 S 43rd Avenue, Phoenix, Ariz. An ultrasound horn is then immersed in the mixture, and the miscible fuel/alcohol solution is then subjected to ultrasound irradiation for fifteen minutes (400 $W/cm^2$, 20,000 Hz). The liquid slurry produced by the sonochemical treatment is then centrifuged (3,000 rpm, 30 minutes), with the resulting clear liquid layer being separated from the solid residue by decantation.

A 20 ml sample is withdrawn from this liquid for sulfur assay, and a fresh ethanol/acetate salt solution is then added to the remaining decanted liquid fuel in the same manner as described above. The sonochemical treatment, followed by decantation, and sampling, as described above, are repeated four times for a total of sixty minutes of sonochemical exposure. The concentration of total sulfur in the fuel is measured as a function of time of exposure to the ultrasound irradiation (15, 30, 45, and 60 minutes).

The sulfur concentration is measured by a sulfur-in-oil-analyzer manufactured by Horiba Instruments Inc. at Edison, N.J. under the trade designation Model SLFA-2100/2800. About 10 ml of a liquid fuel is added to a sample cell. The cell is then inserted into the sulfur-in-oil-analyzer and the concentration of sulfur is registered in ppm in a matter of minutes.

Figure 3:
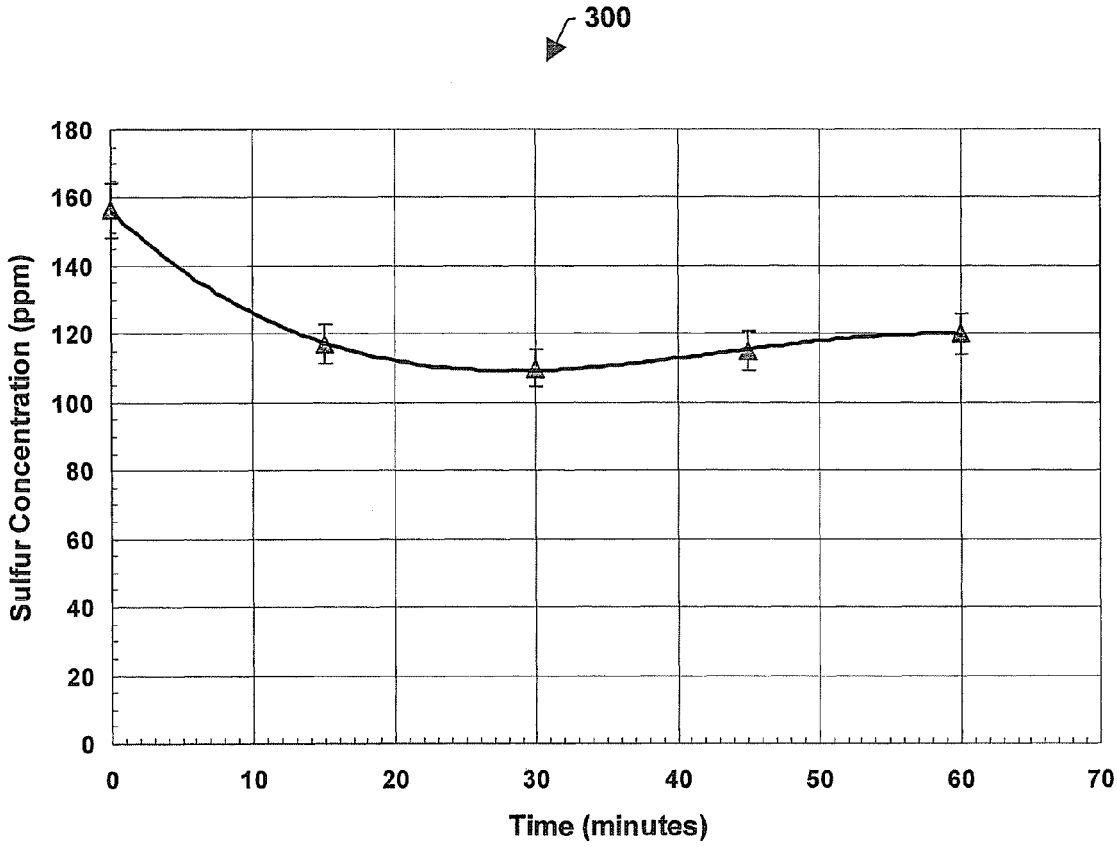
FIG. 3 is a graph demonstrating reduction of sulfur concentration in a liquid fuel in accordance with one aspect of the specification.

The results are shown in the graph 300 in FIG. 3. Approximately 30% of the initial sulfur level in the fuel is removed in fifteen minutes by using this technology.

With respect to any figure or numerical range for a given characteristic, a figure or a parameter from one range may be combined with another figure or a parameter from a different range for the same characteristic to generate a numerical range.

While the innovation has been explained in relation to certain embodiments, it is to be understood that various modifications thereof will become apparent to those skilled in the art upon reading the specification. Therefore, it is to be understood that the innovation disclosed herein is intended to cover such modifications as fall within the scope of the appended claims.

What is claimed is:

1. A method of reducing a sulfur concentration in a liquid fuel, comprising:

combining the liquid fuel and about 0.1 wt. % or more and about 5 wt. % or less of at least one metal acetate and creating a mixture;

transmitting sonochemical vibrations to the mixture under conditions sufficient to facilitate formation of a thiophene/metal complex;

forming the thiophene/metal complex in the mixture and creating a slurry; and substantially removing the thiophene/metal complex from the slurry.

2. The method of claim 1, wherein the metal acetate is acetate of metal element selected from the group consisting of Group VIII metals, Group IB metals, and Group IIB metals of the Periodic Table of Elements.

3. The method of claim 1, wherein the metal acetate is selected from the group consisting of ferric acetate, cobalt acetate, nickel acetate, palladium acetate, platinum acetate, copper acetate, silver acetate, gold acetate, zinc acetate, cadmium acetate, and mercuric acetate.

4. The method of claim 1, wherein the metal acetate is selected from the group consisting of nickel acetate and zinc acetate.

5. The method of claim 1, wherein the transmitting further comprises transmitting ultrasound vibrations with an intensity from about 0.1 $W/cm^2$ to about 10 $W/cm^2$.

6. The method of claim 1, wherein substantially removing the thiophene/metal complexes from the slurry comprises at least one of centrifuging, filtration, decantation, distillation, or combinations thereof.

7. The method of claim 1, wherein the transmitting further comprises transmitting ultrasound vibrations for a time of about 10 minutes to about 40 minutes.

8. The method of claim 1, wherein the transmitting further comprises transmitting ultrasound vibrations at a frequency from about 20 KHz to about 10 MHz.

9. A method of reducing a sulfur concentration in a liquid fuel, comprising:

combining the liquid fuel and about 0.1 wt. % or more and about 5 wt. % or less of the at least one metal acetate to form a mixture;

transmitting ultrasound vibrations with an intensity from about 0.1 $W/cm^2$ to about 10 $W/cm^2$ to the mixture for a sufficient time to facilitate forming a thiophene/metal complex; and substantially removing the mixture from the thiophene/metal complex from the mixture via reactive distillation.

10. The method of claim 9, wherein the metal acetate is acetate of metal element selected from the group consisting of Group VIII metals, Group IB metals, and Group IIB metals of the Periodic Table of Elements.

11. The method of claim 9, wherein the metal acetate is selected from the group consisting of ferric acetate, cobalt acetate, nickel acetate, palladium acetate, platinum acetate, copper acetate, silver acetate, gold acetate, zinc acetate, cadmium acetate, and mercuric acetate.

12. The method of claim 9, wherein the metal acetate is selected from the group consisting of nickel acetate and zinc acetate.

13. The method of claim 9, wherein the transmitting further comprises transmitting the ultrasound vibrations for about 5 minutes or more and about 1 hour or less.

14. The method of claim 9, wherein the transmitting further comprises transmitting the ultrasound vibrations to the mixture in at least one selected from the group consisting of: a batch reactor, a continuous flow reactor, and a semi-continuous flow reactor.

15. The method of claim 9 further comprising:

forming a slurry comprising the mixture and the thiophene/metal complex; and terminating the transmitting when the slurry is formed.

16. The method of claim 9, wherein substantially removing the thiophene/metal complex from the mixture further comprises at least one selected from the group consisting of: centrifuging, filtration, decantation, distillation, or combinations thereof.

17. A method of forming a thiophene/metal complex in a liquid fuel, comprising:

combining the liquid fuel and about 0.1 wt. % or more and about 5 wt. % or less of at least one metal acetate to form a mixture;

transmitting ultrasound vibrations to the mixture facilitate formation of the thiophene/metal complex;

forming a slurry of the mixture and the thiophene/metal complex;

terminating the transmitting the ultrasound vibrations upon forming the slurry; and substantially removing the thiophene/metal complex from the slurry.

18. The method of claim 17, wherein the metal acetate is acetate of metal element selected from the group consisting of Group VIII metals, Group IB metals, and Group IIB metals of the Periodic Table of Elements.

19. The method of claim 17, wherein the metal acetate is selected from the group consisting of ferric acetate, cobalt acetate, nickel acetate, palladium acetate, platinum acetate, copper acetate, silver acetate, gold acetate, zinc acetate, cadmium acetate, and mercuric acetate.

20. The method of claim 17, wherein the metal acetate is selected from the group consisting of nickel acetate and zinc acetate.

* * * * *